US009353957B2

(12) United States Patent
Matsuura et al.

(10) Patent No.: US 9,353,957 B2
(45) Date of Patent: May 31, 2016

(54) REFRIGERANT DISTRIBUTION UNIT FOR AIR CONDITIONER

(75) Inventors: Shun Matsuura, Kawasaki (JP); Haruki Yamashita, Kawasaki (JP)

(73) Assignee: FUJITSU GENERAL LIMITED, Kawasaki-shi (JP)

( * ) Notice: Subject to any disclaimer, the term of this patent is extended or adjusted under 35 U.S.C. 154(b) by 300 days.

(21) Appl. No.: 13/162,125

(22) Filed: Jun. 16, 2011

(65) Prior Publication Data

US 2012/0000230 A1 Jan. 5, 2012

(30) Foreign Application Priority Data

Jun. 30, 2010 (JP) ..... 2010-148520

(51) Int. Cl.

| | |
|---|---|
| ***F24F 1/34*** | (2011.01) |
| ***F24F 1/32*** | (2011.01) |
| ***F24F 1/26*** | (2011.01) |
| ***F25B 30/00*** | (2006.01) |
| ***F25B 41/00*** | (2006.01) |

(52) U.S. Cl.

CPC ... *F24F 1/32* (2013.01); *F24F 1/26* (2013.01); *F24F 1/34* (2013.01); *F25B 30/00* (2013.01); *F25B 41/003* (2013.01)

(58) Field of Classification Search

CPC ..... F24F 1/26; F24F 1/28; F24F 1/30; F24F 13/20; F24F 1/02; F24F 1/34

USPC ..... 62/77, 259.1, 298–299; 285/124.1–124.5, 419, 194, 195; 165/178; 174/51, 57.1, 50, 560, 60, 61; 220/3.2, 3.3, 3.8, 3.5, 3.9

See application file for complete search history.

(56) References Cited

U.S. PATENT DOCUMENTS 3,084,961 A * 4/1963 Merriman ..... 285/242
3,127,471 A * 3/1964 Greiner ..... 174/135

(Continued)

FOREIGN PATENT DOCUMENTS

CN 1158964 A 9/1997
CN 2692568 Y 4/2005

(Continued)

OTHER PUBLICATIONS

Notification of Reasons for Refusal in Japanese Patent Application No. 2010-148520, dated Jul. 2, 2013.

(Continued)

*Primary Examiner* — Travis Ruby
*Assistant Examiner* — Harry Arant
(74) *Attorney, Agent, or Firm* — Venable LLP; Michael A. Sartori; Tamatane J. Aga

(57) ABSTRACT

A refrigerant distribution unit for an air conditioner, includes: a pipe unit for distributing a refrigerant from a refrigerant pipe on an outdoor unit to branch refrigerant pipes on indoor units; and a main body including: upper and lower seal case which include first edge portions around the upper seal case and second edge portions around the lower seal case, and engage the second edge portions with the first edge portions for sealing an inside of the first and second seal cases to store the pipe unit; upper and lower insulator cases for covering the upper and lower seal cases; and upper and lower case constituting a contour of the refrigerant distribution unit. The pipe unit is fixed to a pipe mounting portion of the upper seal case using a pipe holder and a pipe hanging bracket.

2 Claims, 12 Drawing Sheets

(56) References Cited

U.S. PATENT DOCUMENTS

| | | | | |
|---|---|---|---|---|
| 3,224,796 | A * | 12/1965 | Burkitt | 285/149.1 |
| 6,070,659 | A * | 6/2000 | Hosoya | 165/178 |
| 2006/0178246 | A1 * | 8/2006 | Tjerrild | 482/24 |
| 2009/0049855 | A1 * | 2/2009 | Murata et al. | 62/259.1 |
| 2010/0025548 | A1 | 2/2010 | Grivas et al. | |

FOREIGN PATENT DOCUMENTS

| | | | |
|---|---|---|---|
| CN | 2703986 | Y | 6/2005 |
| CN | 1952532 | A | 4/2007 |
| CN | 101109586 | A | 1/2008 |
| EP | 0862023 | A2 | 9/1998 |
| GB | 2451722 | A | 2/2009 |
| JP | 2003-247665 | A | 9/2003 |
| JP | 2006-300381 | A | 11/2006 |

OTHER PUBLICATIONS

Office Action in Chinese Patent Application No. 201110184542.5, dated Jul. 2, 2014.

Extended European Search Report for European Patent Application No. 11171255.0, dated Jun. 19, 2015.

* cited by examiner

*FIG. 11B* C-C

REFRIGERANT DISTRIBUTION UNIT FOR AIR CONDITIONER

This application claims priority from Japanese Patent Application No. 2010-148520, filed on Jun. 30, 2010, the entire contents of which are hereby incorporated by reference.

FIELD OF THE INVENTION

The present disclosure relates to a refrigerant distribution unit for an air conditioner, which incorporates therein a pipe unit for distributing a refrigerant from an outdoor unit of the air conditioner to multiple indoor units thereof and, more specifically, the invention relates to enhancement in the efficiency of maintenance on such refrigerant distribution unit.

DESCRIPTION OF RELATED ART

FIGS. 12A and 12B show a refrigerant distribution unit for an air conditioner according to a related art. The refrigerant distribution unit 15 includes a pipe unit in which refrigerant pipes, that is, a gas pipe 210 and a liquid pipe 211 respectively branch to multiple branch refrigerant pipes, that is, gas pipes 220, 230 and 240 and liquid pipes 221, 231 and 241. Specifically, the refrigerant distribution unit 15 includes: a main body 150 for storing a pipe unit including multiple electronic expansion valves 225, 235 and 245 which are used to adjust the degree of reduction of refrigerants within the multiple branch refrigerant pipes; an electric component box 3 including a control substrate 30 which is electrically connected to the multiple expansion valves 225, 235 and 245 through wires respectively for the electronic expansion valves; an electric component box cover 33 for covering the electric component box 3; and an electric component box mounting plate 32 (hereinafter described as mounting plate 32) including a substrate fit pawl portion for mounting the electric component box 3 onto the main body 150 (see, for example, Japanese Patent Application Publication No. 2006-300381).

The main body 150 includes: a case 6 which is made of a metal plate and includes an upper case 60 and a lower case 61 respectively defining the outer shell portion of the main body 150; an insulator case 5 including an upper insulator case 50 provided within the upper case 60 and a lower insulator case 51 proved within the lower case 61; and, a seal case 4 including an upper seal case 40 provided within the upper insulator case 50 and a lower seal case 41 provided within the lower insulator case 51.

The upper case 60, upper insulator case 50 and upper seal case 40 are respectively divided vertically by a refrigerant pipe receiving portion 151 and a branch refrigerant pipe receiving portion 152. Here, the refrigerant pipe receiving portion 151 is a portion through which the refrigerant pipes, that is, the gas pipe 210 and liquid pipe 211 can be inserted, while the branch refrigerant pipe receiving portion 152 is a portion through which the multiple branch refrigerant pipes, that is, the branch gas pipes 220, 230 and 240 and branch liquid pipes 221, 231 and 241 can be inserted. The refrigerant pipes are connected by a gas pipe joint 212 and a liquid pipe joint 213 to refrigerant pipes which are connected to the outdoor unit of the air conditioner. The multiple branch refrigerant pipes are connected by branch gas pipe joints 222, 232 and 242 and branch liquid pipe joints 223, 233 and 243 to refrigerant pipes which are connected to the multiple indoor units of the air conditioner.

In the case of the refrigerant pipes, the gas pipe 210 and liquid pipe 211 are bundled together by the refrigerant pipe receiving portion 151, and are held horizontally by the vertically divided upper seal case 40 and lower seal case 41 and by the vertically divided upper insulator case 50 and lower insulator case 51. In the case of the branch refrigerant pipes, the branch liquid pipe 221 and branch gas pipe 220 are bundled together, the branch liquid pipe 231 and branch gas pipe 230 are bundled together, the branch liquid pipe 241 and branch gas pipe 240 are bundled together. The vertically divided multiple branch refrigerant pipe receiving portions 152 are closely contacted with each other, whereby the branch refrigerant pipes can be held horizontally.

The refrigerant distribution unit 15, in most cases, is installed (hanged) horizontally on a back face of an indoor ceiling. However, when the lower case 61, lower insulator case 51 and lower seal case 41 are removed in maintenance on the unit 15, since the pipe unit is not fixed to the main body 150, the pipe unit is flexed downward due to its own weight. Due to this, in a state where the refrigerant distribution unit 15 remains hanging on the back face of the ceiling, maintenance on the peripheral parts of the pipe unit is impossible. Therefore, according to the related art, it is necessary to remove the refrigerant distribution unit 15 from the ceiling and take the refrigerant distribution unit 15 to pieces, which results in the poor efficiency of the maintenance.

SUMMARY OF INVENTION

Illustrative aspects of the present invention provide a refrigerant distribution unit for an air conditioner which, in a state where its main body is hanged, allows maintenance on the peripheral parts of its pipe unit without taking the refrigerant distribution unit to pieces.

According to a first aspect of the invention, a refrigerant distribution unit for an air conditioner, is provided with: a pipe unit for distributing a refrigerant from a refrigerant pipe provided on an outdoor unit to a plurality of branch refrigerant pipes respectively provided on a plurality of indoor units; and a main body including: an upper seal case and a lower seal case which include first edge portions in a periphery of the upper seal case and second edge portions in a periphery of the lower seal case, and engage the second edge portions with the first edge portions for sealing an inside of the first and second seal cases to store the pipe unit; an upper insulator case and a lower insulator case for covering the upper seal case and the lower seal case respectively; and an upper case and a lower case respectively constituting a contour of the refrigerant distribution unit, wherein the upper seal case includes a pipe mounting portion in which a contact face with the pipe unit is extended from the first edge portions, wherein the pipe unit is fixed to the pipe mounting portion using a pipe holder and a pipe hanging bracket, and wherein an upper portion of the pipe hanging bracket is fixed to the upper case, and a lower portion of the pipe hanging bracket is extended to a lower end of the pipe holder.

Other aspects and advantages of the invention will be apparent from the following description, the drawings and the claims.

BRIEF DESCRIPTION OF THE DRAWINGS

FIG. 10A is a bottom view showing a state where an electric component box is mounted on the right side face thereof when viewed from the outdoor unit side thereof, while FIG. 10B is a bottom view showing a state where an electric component box is mounted on the left side face thereof when viewed from the outdoor unit side thereof.

FIGS. 11A and 11B are perspective views showing the refrigerant distribution unit. FIG. 11A is a perspective view showing a state where its lower case is mounted, while FIG. 11B is an enlarged perspective section view taken along the C-C line shown in FIG. 11A.

FIG. 12A is an exploded perspective view thereof, while FIG. 12B is a section view thereof.

DETAILED DESCRIPTION OF EXEMPLARY EMBODIMENTS

Now, description will be given below specifically of the best mode for carrying out the invention, using an exemplary embodiment thereof with reference to FIGS. 1 to 11B.

<Air Conditioner>

Figure 1:
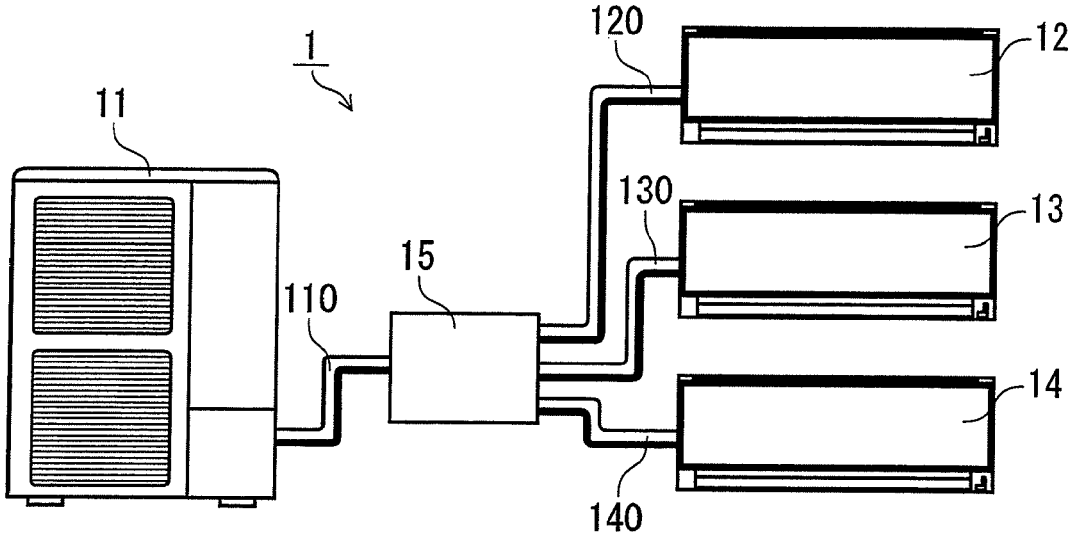
FIG. 1 is a schematic structure view showing an air conditioner according to the exemplary embodiment of the invention.

An air conditioner 1 shown in FIG. 1 includes an outdoor unit 11, and multiple indoor units 12, 13 and 14.

The outdoor unit 11 includes the following composing parts (none of which are shown): that is, an outdoor heat exchanger; a portion of a refrigerant circuit for a compressor, a four way valve and the like; a fan for blasting air in order to exchange heat between a refrigerant within the outdoor heat exchanger and the open air; a fan motor for driving the fan; and a control circuit for controlling the above composing parts.

The indoor units 12, 13 and 14 respectively include the following composing parts (none of which are shown): that is, a portion of a refrigerant circuit for an indoor heat exchanger and the like; a fan for blasting air in order to exchange heat between a refrigerant within the indoor heat exchanger and the open air; a fan motor for driving the fan; and a control circuit for controlling the above composing parts.

The refrigerant circuit of the outdoor unit 11 is connected to the refrigerant circuits of the indoor units 12, 13 and 14 through an outdoor unit side pipe 110 and indoor unit side pipes 120, 130 and 140 respectively. Between the outdoor unit 11 and the multiple indoor units 12, 13 and 14, there is interposed a refrigerant distribution unit 15 which is used to distribute refrigerants uniformly refrigerant from the outdoor unit side pipe 110 to the indoor unit side pipes 120, 130 and 140.

<Refrigerant Distribution Unit>

Figure 2:
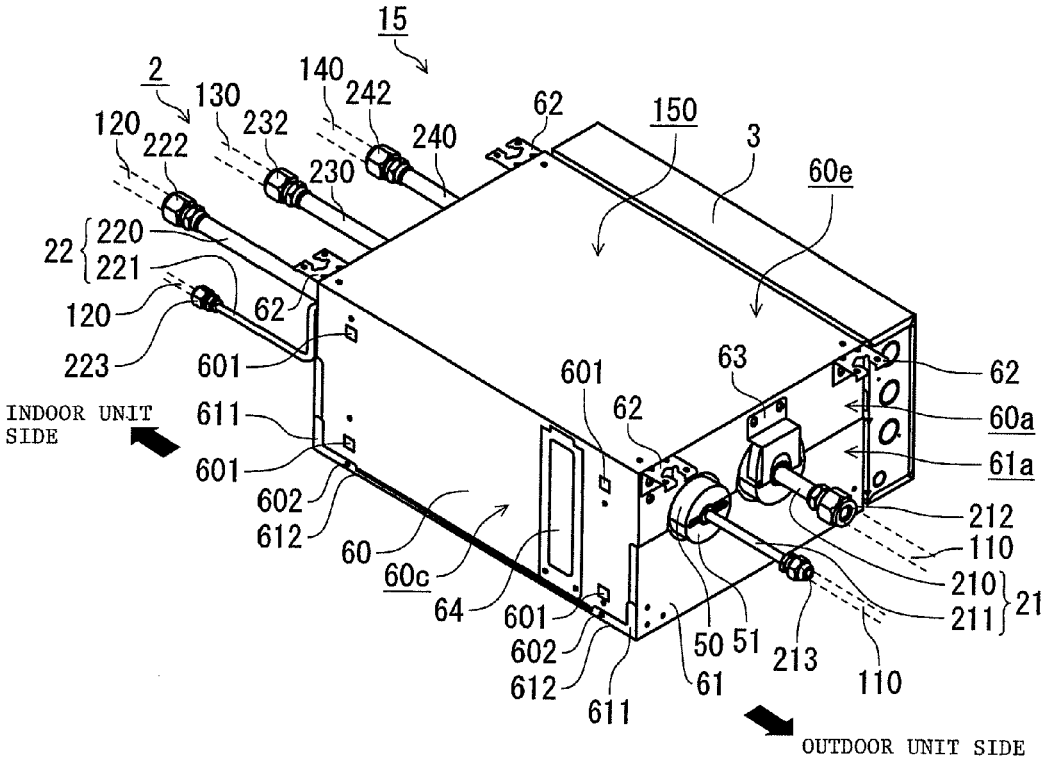
FIG. 2 is a perspective view showing a refrigerant distribution unit according to the exemplary embodiment.

The refrigerant distribution unit 15 shown in FIG. 2 includes: a pipe unit 2 for connecting the outdoor unit side pipe 110 to the respective indoor unit side pipes 120, 130 and 140 to distribute the refrigerant from the outdoor unit side pipe 110 to the indoor unit side pipes 120, 130 and 140; a main body 150 for storing the pipe unit 2; and an electric component box 3 including a control portion for controlling the electric components that are mounted on the pipe unit 2.

The refrigerant distribution unit 15 is horizontally hanged from and fixed to an indoor ceiling or the like by multiple pieces of ceiling-mounting brackets 62. And, in order to adjust to the environment of the ceiling which is liable to be hot and humid, especially, the inside of the main body 150 is structured such that it has an insulating property which can prevent it against the influence of temperature variations and also that it is sealed in order to prevent it against the influence of humidity.

The pipe unit 2, as shown in FIGS. 2, 3, 4 and 5, includes a refrigerant pipe 21 to be connected to the outdoor unit side pipe 110, a branch portion 25 to be stored into the main body 150, and branch refrigerant pipes 22, 23 and 24 respectively to be connected to their associated indoor unit side pipes 120, 130 and 140.

The refrigerant pipe 21 includes a gas pipe 210 and a liquid pipe 211. The gas pipe 210 includes a gas pipe joint 212 in the vicinity of the refrigerant distribution unit 15, while the liquid pipe 211 includes a liquid pipe joint 213 in the vicinity of the refrigerant distribution unit 15. Due to the gas pipe joint 212 and liquid pipe joint 213, the gas pipe 210 and liquid pipe 211 can be connected to and removed from the outdoor unit side pipe 110.

The gas pipe 210 and liquid pipe 211 are arranged horizontally and are spaced 40 mm or more from each other, while they can be stored into the main body 150 from a refrigerant pipe receiving portion 151.

The branch refrigerant pipes 22, 23 and 24 include branch gas pipes 220, 230 and 240 and branch liquid pipes 221, 231 and 241, respectively. The branch gas pipes 220, 230 and 240 include branch gas pipe joints 222, 232 and 242 in the vicinity of the refrigerant distribution unit 15, respectively; and the branch liquid pipes 221, 231 and 241 include branch liquid pipe joints 223, 233 and 243 on a side of the refrigerant distribution unit 15, respectively. Due to the branch gas pipe joints 222, 232 and 242 and branch liquid pipe joints 223, 233 and 243, the branch refrigerant pipes 22, 23 and 24 can be connected to and removed from the indoor unit side pipes 120, 130 and 140, respectively.

The branch gas pipes 220, 230 and 240 are respectively formed to have a linear shape. The branch liquid pipes 221, 231 and 241 are respectively disposed downwardly of and spaced a given distance from the branch gas pipes 220, 230 and 240, and are bent upwardly on the side of the main body 150; after then, they are respectively bundled together by their associated rubber bushes 26 such that the branch gas pipe 220 and branch liquid pipe 221 are formed into a unified body, the branch gas pipe 230 and branch liquid pipe 231 are formed into a unified body, and the branch gas pipe 240 and branch liquid pipe 241 are formed into a unified body. Also, the branch refrigerant pipes 22, 23 and 24 are arranged horizontally and are spaced 40 mm or more from each other, while the branch refrigerant pipes 22, 23 and 24 can be stored into the main body 150 from a branch refrigerant pipe receiving portion 152.

<Branch Portion>

Figure 4:
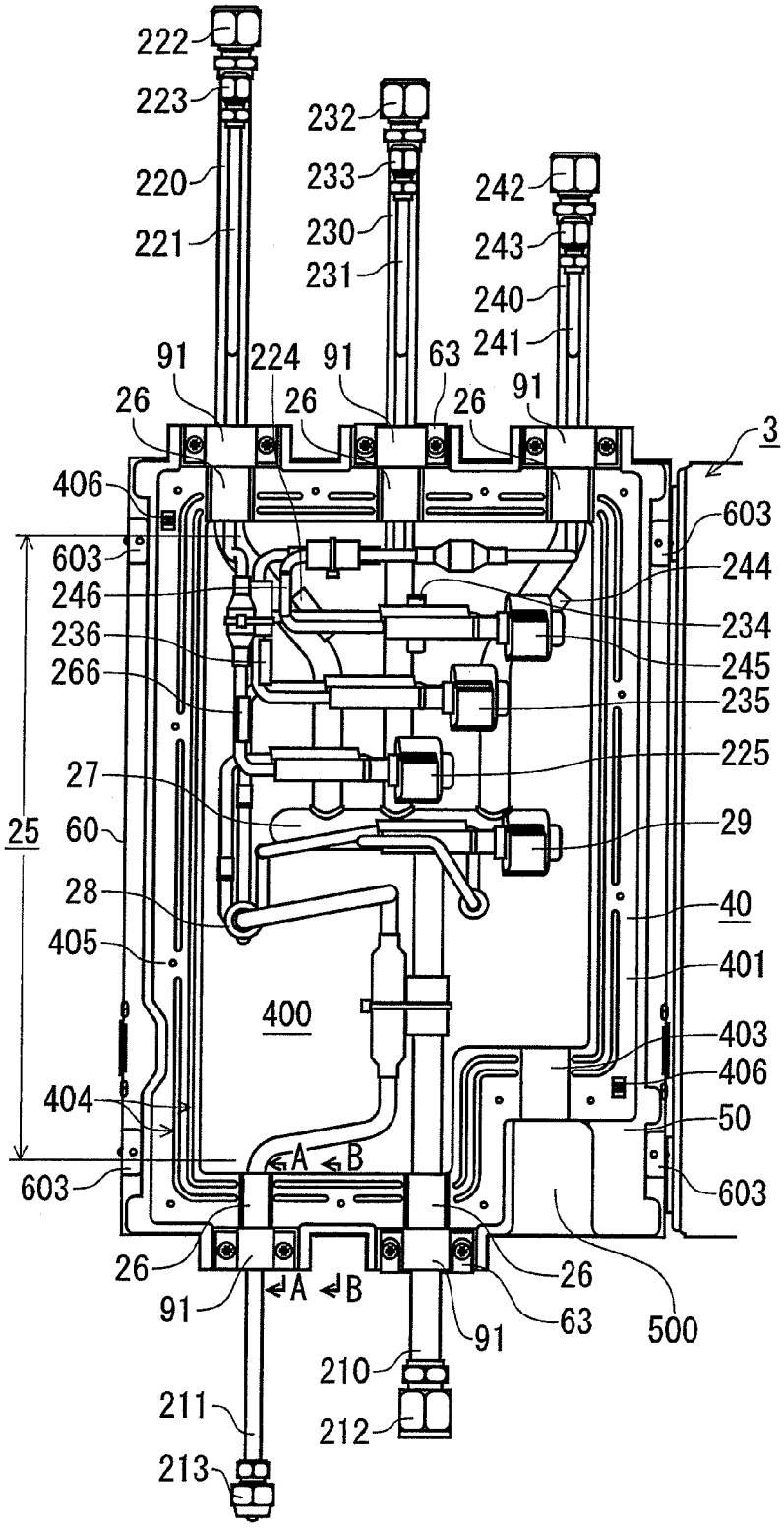
FIG. 4 is an internal structure view showing the refrigerant distribution unit.

The branch portion 25 of the pipe unit 2 shown in FIG. 4 includes: a branch pipe 27 which makes the gas pipe 210 branch to the branch gas pipes 220, 230 and 240; branch gas pipe temperature sensors 224, 234 and 244 provided on the branch gas pipes 220, 230 and 240 respectively; a flow divider 28 for diverging the refrigerant of the liquid pipe 211 to the branch liquid pipes 221, 231 and 241; electronic expansion valves 225, 235 and 245 respectively for adjusting amounts of the refrigerants flowing through their associated branch liquid pipes 221, 231 and 241; branch liquid pipe temperature sensors 226, 236 and 246 which are disposed nearer to the indoor units 12, 13 and 14 than the electronic expansion valves 225, 235 and 245 respectively; and, an on/off valve 29 for bypassing the refrigerant from the branch pipe 27 to the flow divider 28.

<Cable>

To the branch gas pipe temperature sensors 224, 234 and 244 and branch liquid pipe temperature sensors 226, 236 and 246, there are connected signal lines for transmitting the detected results of the sensors 224, 234, 244, 226, 236 and 246 to the control substrate 30 of the electric component box 3. To the electronic expansion valves 225, 235 and 245 as well as to the on/off valve 29, there are connected wires which are used to drive the valves 225, 235, 245 and 29 respectively. The signal lines and wires are bundled together to provide a cable 80, while the cable 80 is connected to the control substrate 30 of the electric component box 3.

<Main Body>

Figure 5:
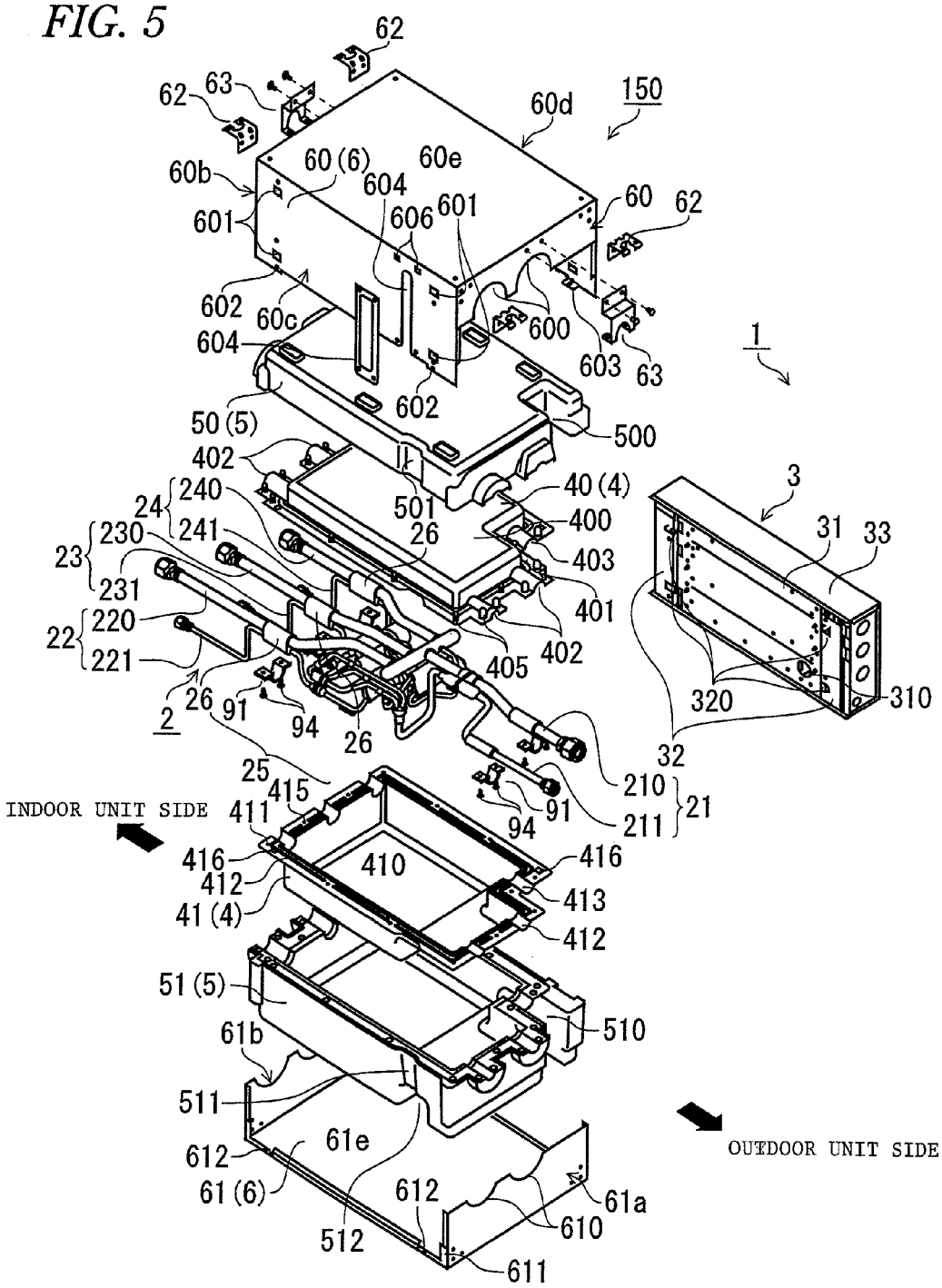
FIG. 5 is an exploded view showing the refrigerant distribution unit.

The main body 150 shown in FIG. 5 is structured such that the pipe unit 2 can be held by a seal case 4, an insulator case 5 and a case 6 which are arranged sequentially in this order from inside.

<Seal Case>

The seal case 4 is formed of synthetic resin and includes an upper seal case 40 and a lower seal case 41 which are divided vertically along centers of pipe diameters of the horizontally extending refrigerant pipe 21 and branch refrigerant pipes 22, 23 and 24.

Figure 3:
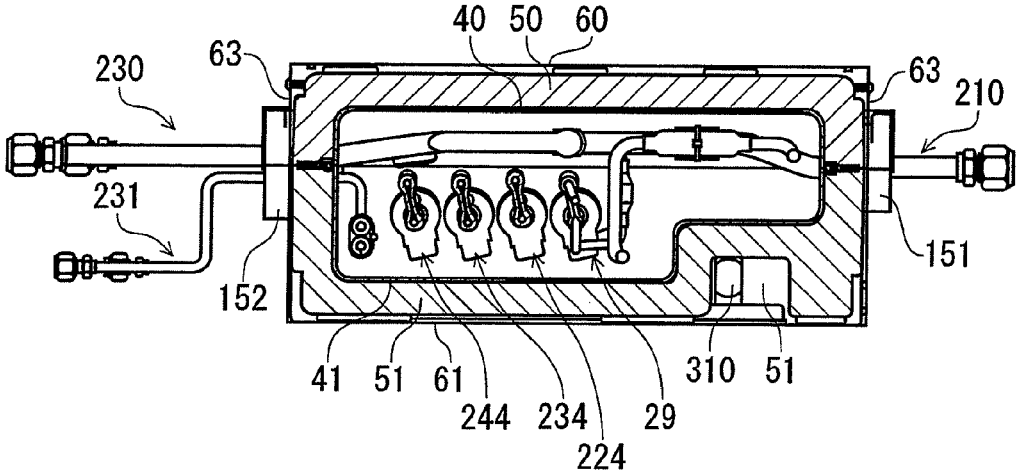
FIG. 3 is a section view showing the refrigerant distribution unit.

The upper seal case 40 shown in FIGS. 3, 4 and 5 includes a storage portion 400 for storing the branch portion 25 of the pipe unit 2, and an edge portion 401 formed on the periphery of the storage portion 400 for keeping the seal property thereof.

In the edge portion 401, specifically, on the refrigerant pipe receiving portion 151 for receiving the refrigerant pipe 21 and also on the branch refrigerant pipe receiving portion 152 for receiving the branch refrigerant pipes 22, 23, 24, there are provided (there are extended continuously therefrom) pipe mounting portions 402 which respectively draw a semi-circular shape along the pipes. On the semi-circular right and left end portions of the pipe mounting portion 402, there are erected anchors 405 which are respectively used to receive screws (which will be discussed later).

Also, there is also formed a cable draw-out portion 403 which has a semi-circular shape and is used to draw out the cable 80. Further, in the edge portion 401, there are provided projecting ribs 404 which extend in two lines in such a manner as to surround the storage portion 400. On the projecting ribs 404, there are bonded insulating seals 44 (see FIG. 8) respectively.

Of the two-lined projecting ribs 404, the projecting rib 404 disposed outside includes the anchors 405 which are respectively erected and are spaced from each other for receiving screws (which will be discussed later). The anchors 405 are further erected on the four corners of the edge portion 401 as well.

The lower seal case 41 includes a storage portion 410 for storing the branch portion 25 of the pipe unit 2, and an edge portion 411 which is formed on the periphery of the storage portion 410 and is used to keep the sealing property of the storage portion 410.

In the edge portion 411, specifically, in such portions of the edge portion 411 as are to be contacted with the refrigerant pipe 21 and branch refrigerant pipes 22, 23 and 24, there are continuously formed pipe mounting portions 412 which respectively have a semi-circular shape; and also, there are continuously formed cable draw-out portions 413 which respectively have a semi-circular shape. Also, in the edge portion 411, there are formed recessed ribs 412 which are used to receive the projecting ribs 404 respectively. Further, there are formed screw holes 415 which can be engaged with their associated anchors 405.

<Insulator Case>

The insulator case 5 is formed of highly heat-resisting styrene foam and has a constant thickness over the entire area thereof in order to enhance its heat-resisting property.

Such portions of the insulator case 5 as correspond to the refrigerant pipe receiving portion 151 and branch refrigerant pipe receiving portion 152 are respectively projected out in a cylindrical manner; and the insulator case 5 is divided into an upper insulator case 50 and a lower insulator case 51 along the centers of the pipe diameters of the refrigerant pipe 21 and branch refrigerant pipes 22, 23 and 24.

A shape of the inside of the upper insulator case 50 is formed to fit the outer shape of the upper seal case 40. Also, the upper insulator case 50 includes a cable draw-out recessed portion 500 which is formed to fit the cable draw-out portion 403 of the upper seal case 40. And, in the left side face of the upper insulator case 50 when viewed from the outdoor unit side, there is formed a cable side face recessed portion 501 which is used to introduce the cable 80 which has been drawn out, into the electric component box 3.

A shape of the inside the lower insulator case 51 is formed to fit the outer shape of the lower seal case 41. Also, the lower insulator case 51 includes a cable draw-out recessed portion 510 which is formed to fit the cable draw-out portion 413 of the lower seal case 41. And, in the left side face of the lower insulator case 51 when viewed from the outdoor unit side, there is formed a cable side face recessed portion 511 which is used to introduce the cable 80 which has been drawn out, into the electric component box 3. Further, in the bottom face of the lower insulator case 51, there is formed a bottom face recessed portion 512 for the cable.

<Case>

The case 6, which constitutes the contour of the main body 150, can be formed by bending a metal sheet. And, the case 6 includes an upper case 60 and a lower case 61.

The upper case 60 has a box-like shape. Specifically, the upper case 60 includes an outdoor unit side lateral portion 60*a*, an indoor unit side lateral portion 60*b* which is disposed opposed to the outdoor unit side lateral portion 60*a*, a first lateral portion 60*c* disposed on the left when the upper case 60 is viewed from the outdoor unit 11 side, and a second lateral portion 60*d* which is situated on the right and is disposed opposed to the first lateral portion 60*cc*.

The outdoor unit side lateral portion 60*a* and indoor unit side lateral portion 60*b* respectively include upper insulator receiving portions 600 which are formed by cutting out the lateral portions 60*a* and 60*b* in a semi-circular shape to fit the cylindrical shape of the upper insulator case 50 and each of which has such a length as extends to the centers of the pipe diameters of the refrigerant pipe 21 and branch refrigerant pipes 22, 23 and 24. And, in the right and left end portions of the lateral portions 60*a* and 60*b*, there are formed screw holes into which there can be engaged the ceiling-mounting brackets 62 for hanging down the refrigerant branch unit 2 from the ceiling; and, in the central portions of the lateral portions 60*a* and 60*b*, there are formed screw holes into which there can be engaged pipe hanging bracket 63 which will be discussed later.

The first lateral portion 60*c* and second lateral portion 60*d* respectively have such a length as reaches the bottom face of the main body; and, the first lateral portion 60*c* and second lateral portion 60*d* respectively include, at the four upper and lower portions of the right and left end portions thereof, electric component box securing holes 601 (hereinafter described as securing holes 601) into which there can be engaged their associated electric component box securing pawls 320 (hereinafter described as securing pawls 320, which will be discussed later) to thereby mount the electric component box 3 onto the case 6. Downwardly of the positions of the securing holes 601 formed in the lower portions of the right and left ends portions, there are provided dowels 602 which can be removably secured to dowel holes 612 (which will be discussed later). Also, downwardly of the dowels 602, there are formed screw mounting portions 603 which are extended up to the bottom surface of the case 6.

In the first lateral portion 60*c*, there is formed a first cable draw-out slot 604 constituted of a cut-out groove which exists on the outdoor unit 11 side and extends up to the vicinity of the ceiling surface of the case 6; and, the first cable draw-out slot 604 is cut through from the bottom thereof to the top. In the second lateral portion 60*d* shown in FIG. 6, there is formed a second cable draw-out slot 605 constituted of a cut-out groove which exists on the outdoor unit 11 side and extends up to the middle portion of the second lateral portion 60*d*. In such portions of the first and second lateral portions 60*c* and 60*d* as exist near to the ceiling surface 60*e* and in the vicinity of the first and second cable draw-out slots 604 and 605, there are formed cable draw-out slot cover holes 606 to which cable draw-out slot covers 64 (which will be discussed later) can be secured.

The lower case 61 has a U-like shape and includes an outdoor unit side lateral portion 61*a*, an indoor unit side lateral portion 61*b*, and a bottom face portion 61*e*.

The outdoor unit side lateral portion 61*a* and indoor unit side lateral portion 61*b* respectively include upper insulator receiving portions 610 which are formed by cutting out the respective portions 61*a* and 61*b* in a semi-circular shape to fit the cylindrical shape of the lower insulator case 51 and also which respectively have a length reaching the centers of the pipe diameters of the refrigerant pipe 21 and branch refrigerant pipes 22, 23 and 24.

A metal plate, which is used to form the lower case 61, includes flange portions 611 which are formed by extending two end portions of the bottom face portion 61*e*, bending and spot welding the flange portions 611 to the outdoor unit side lateral portion 61*a* and indoor unit side lateral portion 61*b*.

The flange portions 611 respectively include dowel holes 612 to which, when the lower case 61 is assembled, there can be removably secured the dowels 602. In such portions of the bottom face portion 61*e* as exist near to the dowel holes 612, there are formed holes for screws.

<Electric Component Box>

Figure 6:
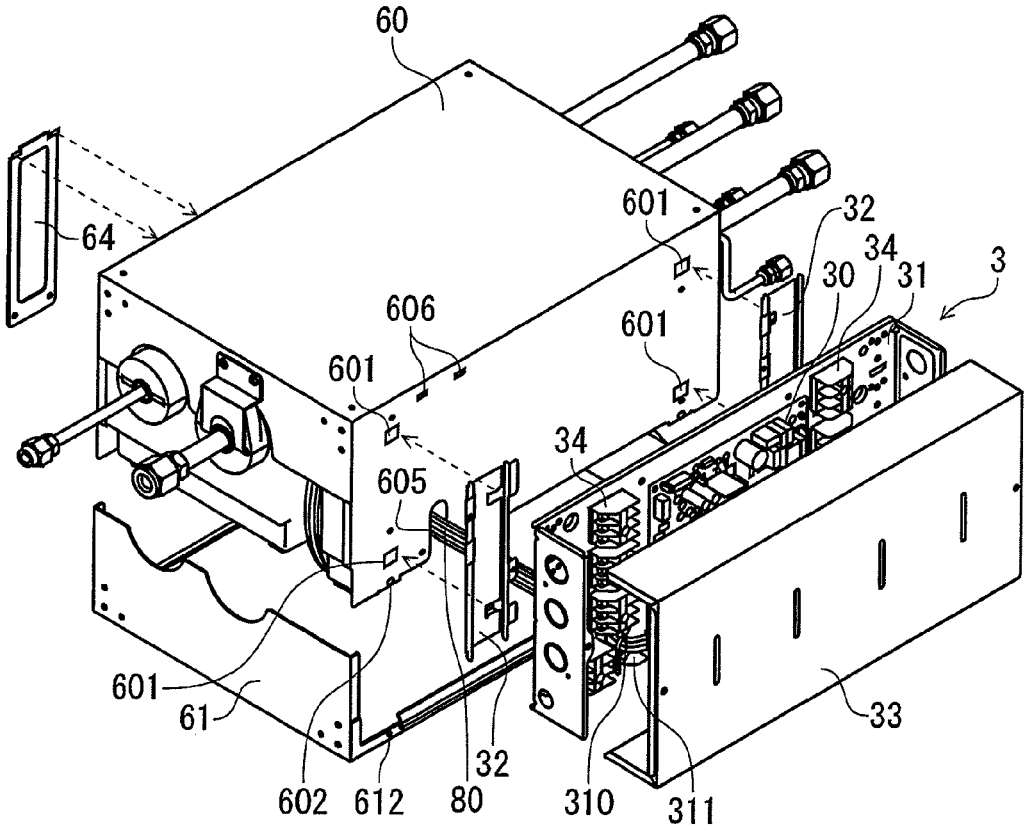
FIG. 6 is an exploded view showing a lower case and an electric component box included in the refrigerant distribution unit.

The electric component box 3 shown in FIGS. 5 and 6 includes a control substrate 30 for controlling the refrigerant branch unit 15, an electric component box main body 31, two mounting plates 32, and an electric component box cover 33.

The electric component box main body 31 is constituted of a metal plate having a U-like shape; and, within the U-like shape, there are disposed the control plate 30 and multiple terminal bases 34. In a portion of the electric component box main body 31, there is formed a cable guide hole 310 which is used to guide the cables 80; and, in such inside portion of the electric component box main body 31 as exists near to the cable guide hole 310, there is provided a cable guide 311 which is used to bundle together the cables 80 and guide them to the control substrate 30.

The mounting plates 32 respectively have a rectangular shape, include securing pawls 320 so formed in the two upper and lower portions thereof as to be bent inwardly symmetrically, and are welded to the right and left portions of the outside of the electric component box main body 31.

<Assembling Method>

The refrigerant branch unit 15 may be assembled in such a manner that, when compared with its installing state where it is hanged down from the ceiling, it is turned upside down. First, the upper case 60 is placed with its ceiling face portion 60*e* facing downward and then the upper insulator case 50 is superimposed on top of the inside of the upper case 60. The upper insulator case 50 is supported by the insulator receiving portion 600 of the upper case 60.

Figure 7:
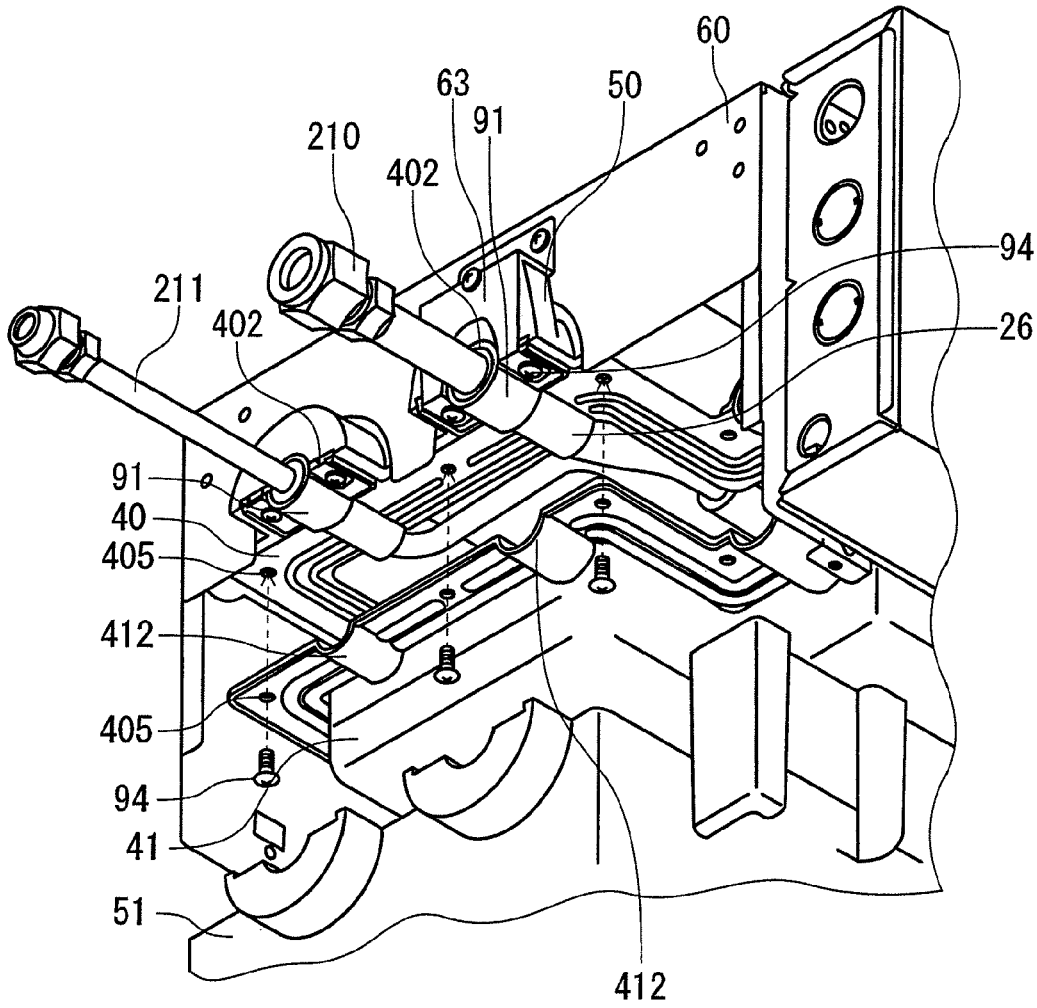
FIG. 7 is a detail view showing a refrigerant pipe receiving portion included in the refrigerant distribution unit.

Next, as shown in FIGS. 4 and 7, the upper seal case 40 is fitted into the upper insulator case 50. And, the pipe unit 2 is fitted into the pipe mounting portions 402 of the upper seal case 40. Such portions of the gas pipe 210, liquid pipe 211 and branch refrigerant pipes 22, 23 and 24 of the pipe unit 2 as are wound by the rubber bushes 26 are fitted into the pipe mounting portions 402, and pipe holders 91 are fastened and fixed to the pipe mounting portions 402 from above the rubber bushes 26 using screws.

Figure 8:
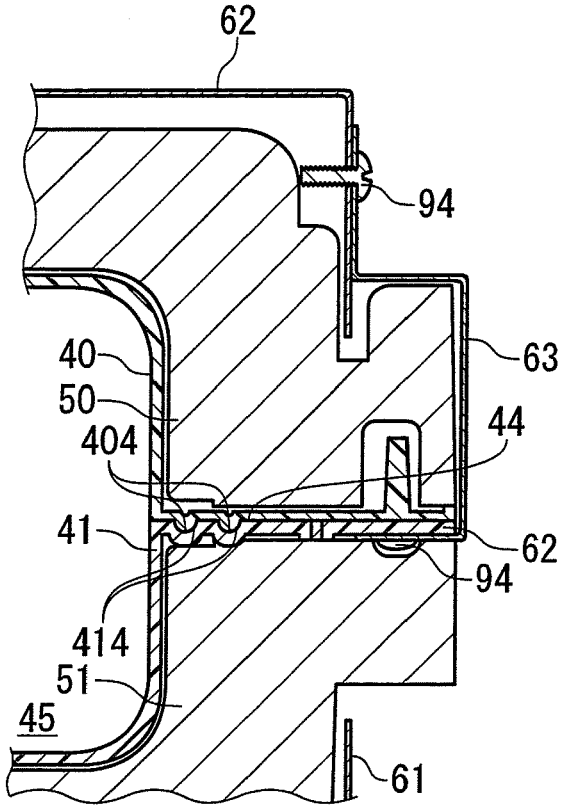
FIG. 8 is a section view showing the refrigerant distribution unit taken along the A-A line shown in FIG. 4.
Figure 9:
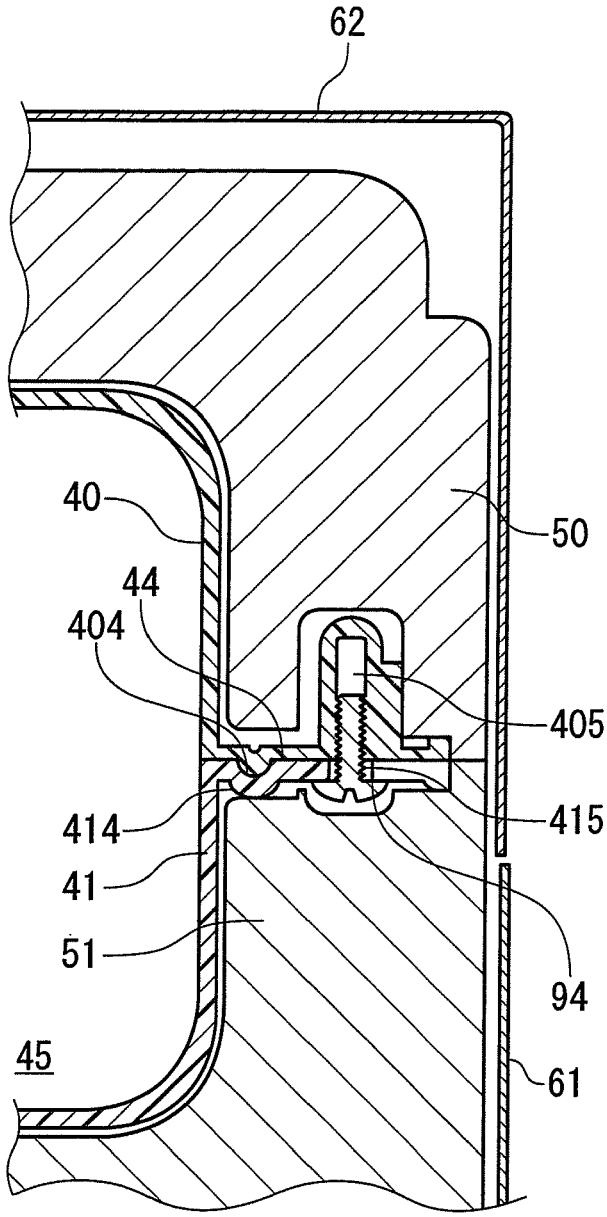
FIG. 9 is a section view showing the refrigerant distribution unit taken along the B-B line shown in FIG. 4.

Next, as shown in FIGS. 7 to 9, for the gas pipe 210 and the pipe mounting portion 402 of the branch refrigerant pipe 23, a pipe hanging bracket 63 with its upper end engaged with the upper case 60 is so provided as to extend over the upper insulator case 50 down to the lower end portion of the pipe holder 91. And, the pipe hanging bracket 63 and pipe holder 91 are fastened together with a screw and are then fixed to the upper seal case 40.

The cables 80 are bundled together by a binding tool 82 and are drawn out to the outside from the cable receiving portion 403 of the upper seal case 40.

According to the above-mentioned configuration, the pipe unit 2 is fixed to the pipe mounting portion 402 of the upper seal case 40 by the pipe holder 91 and pipe hanging bracket 63. The upper portion of the pipe hanging bracket 63 is fixed to the upper case 60 and the lower portion of the pipe hanging bracket 63 extends down to the lower end of the pipe holder 91. Thus, the branch portion 25, electronic expansion valves 225, 235 and 245, etc. respectively constituting the pipe unit 2 are exposed to the outside by removing the lower case 60, lower insulator case 51 and lower seal case 41. Therefore, it is possible to carry out maintenance on the pipe unit 2 without taking the main body 150 to pieces.

Next, the seal case securing hole 410 of the lower seal case 41 is inserted in such a manner that the seal case securing hole 410 can be engaged with the seal case securing pawl 406 projected from the upper seal case 40. In the case that the upper seal case 40 and lower seal case 41 are engaged with each other, the recessed rib 414 of the lower seal case 41 is closely contacted with the projecting rib 404 of the upper seal case 40 through the insulating seal 44 with no gap between the projecting rib 404 and the recessed rib 414. Next, screws 94 are engaged through screw holes 415 with the anchors 405 which are respectively provided in the multiple portions of the edge portion 401.

As shown in FIG. 7, the pipe mounting portion 412 of the lower seal case 41 is structured such that the pipe mounting portion 412 can be fitted with the rubber bushes 26 of the gas pipe 210 and liquid pipe 211 respectively stored in the upper seal case 40 but is prevented from covering the pipe mounting portion 402 of the upper seal case 40. Thus, the upper seal case 40 and lower seal case 41 are superimposed on top of each other with no gap between them, whereby the interior portion of the seal case 4 can be kept hermetically sealed. Owing to the hermetically sealed state of the interior portion of the seal case 4, the branch portion 25 of the pipe unit 2 stored within the main body 150 is prevented from touching the air existing on the outside, thereby being able to prevent drain water from being generated.

Next, the lower insulator case 51 is placed on top of the lower seal case 41. In this case, besides the lower insulator case 51, the screws 94, which have been engaged with the pipe holder 91 and pipe hanging bracket 63, are also covered with the lower insulator case 51. This can also prevent water or like from touching the screws 94.

Figure 10A:
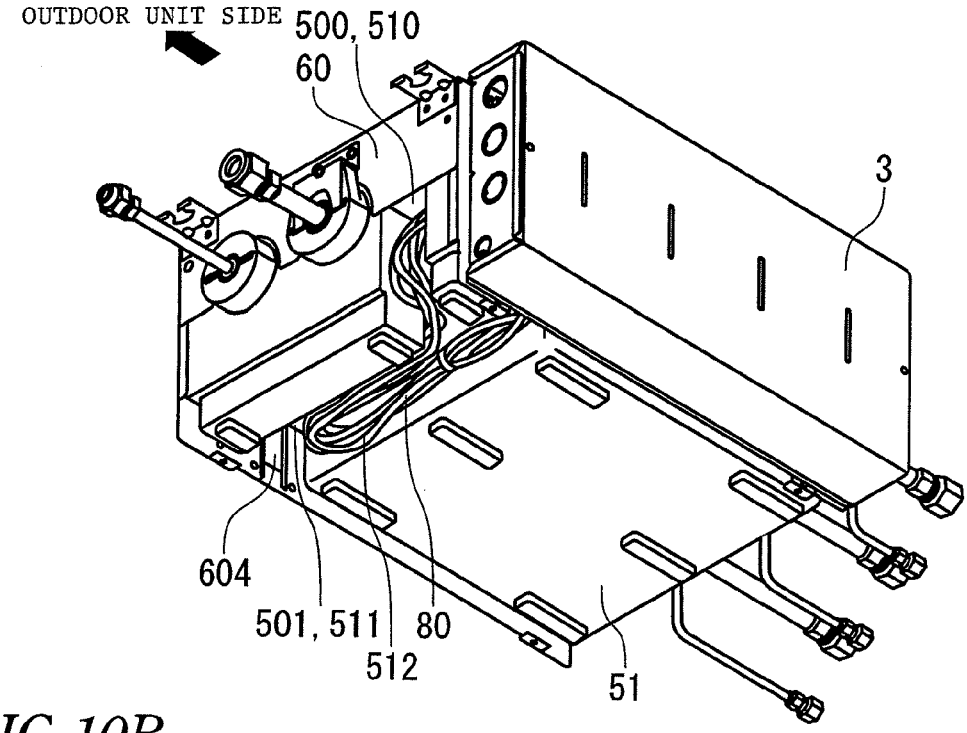
FIGS. 10A and 10B are bottom views showing the refrigerant distribution unit with its lower case removed therefrom.

The electric component box 3 may be mounted onto any one of the first and second lateral portions 60*c* and 60*d* of the upper case 60. When mounting the electric component box 3 onto the second lateral portion 60*d* which is the right lateral face when viewed from the outdoor unit side, as shown in FIG. 10A, the cables 80 are guided along the draw-out recessed portion 500 of the upper insulator case and the draw-out recessed portion 510 of the lower insulator case to the first cable bottom face recessed portion 512. The cables 80, which have been guided to the cable bottom face recessed portion 512, are turned back at the cable bottom face recessed portion 512 and are drawn out from the second cable draw-out slot 605 to the outside of the main body 150.

The thus drawn-out cables 80, as shown in FIG. 6, are guided from the cable guide hole 310 of the electric component box main body 31 into the electric component box 3, are bundled to the electric component box main body 31 by the cable guide 311, and are then connected to multiple connectors (not shown) which are provided on the control substrate 30 of the electric component box 3.

The electric component box main body 31, which has been connected to the cables 80, inserts the securing pawl 320 of the mounting plate 32 welded to the electric component box main body 31 into the securing hole 601 of the upper case 60. In this case, the securing pawl 320, specifically, the upper pawl thereof is held in a state where the upper pawl is hanging down, whereby the electric component box 3 is provisionally fixed by the securing pawl 320. Next, the electric component box 3 is engaged from inside of the electric component box main body 31 with the upper case 60 using screws. As a result, the electric component box 3, which is provisionally fixed by the securing pawl 320, is fixed. Then, the electric component box cover 33 is placed on top of the electric component box 3.

Figure 10B:
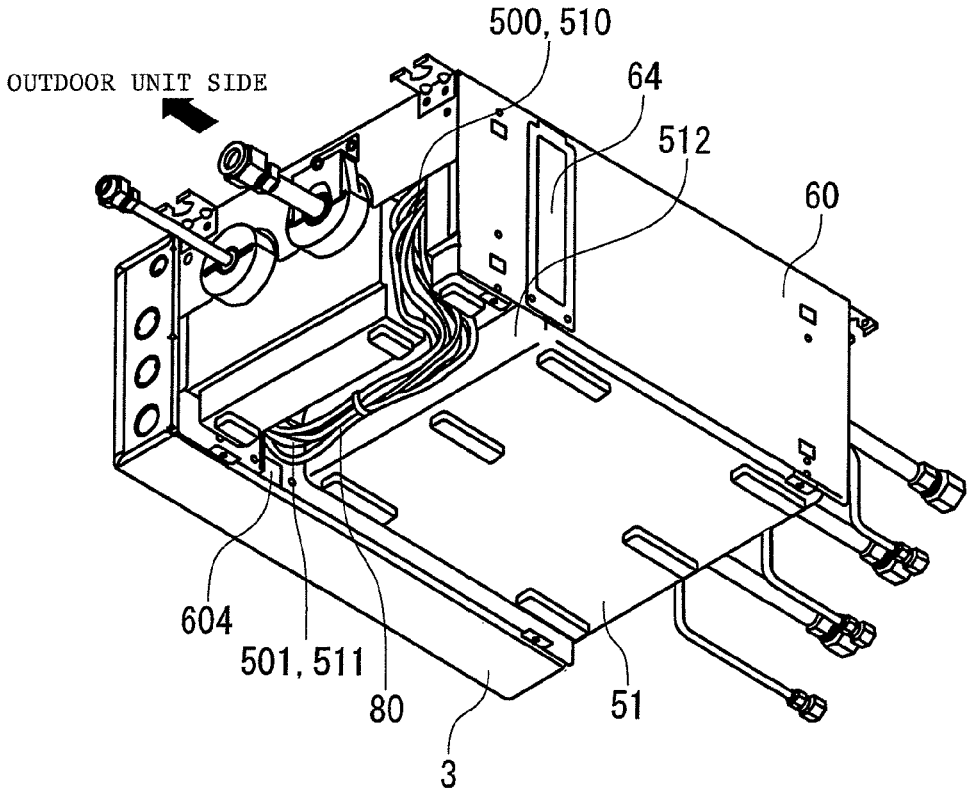

Also, as shown in FIG. 10B, when mounting the electric component box 3 onto the first lateral portion 60*c* which is situated on the left when the upper case 60 is viewed from the outdoor unit side, the electric component box main body 31 is turned upside down and the securing pawl 320 of the mounting plate 32 is inserted into the securing hole 601 of the upper case 6. Since the electric component box main body 31 is turned upside down, the cable guide hole 310 is moved to the ceiling side.

The cables 80, which have been guided to the cable bottom face recessed portion 512, are moved over the cable bottom face recessed portion 512, are moved through the cable side face recessed portions 501 and 511, are drawn out from above the first cable draw-out slot 604 to the outside of the main body 150, and are guided from the cable guide hole 310 of the electric component box main body 31 into the electric component box 3.

According to the mounting method, for example, even when moving the electric component box 3 from one place to the other place according to the site where the is electric component box 3 mounted in the air conditioner is installed, the electric component box 3 can be moved simply with the cables 80 remaining connected.

Next, a cable draw-out slot cover 64 is mounted onto any one of the first cable draw-out slot 604 and second cable draw-out slot 605 which are formed in the portion of the upper case 60 where the electric component box 3 is not installed. Since the cable draw-out slot cover 64 is formed longer than the cable draw-out slot 604, and also since cable draw-out cover holes 606 are formed at the symmetric positions of the first and second lateral portions 60*c* and 60*d*, the cable draw-out slot cover 64 can be mounted onto any one of the lateral portions. The upper pawls of the cable draw-out slot cover 64 are secured to the cable draw-out slot cover holes 606, and then the cable draw-out slot cover 64 is engaged with the upper case 60 using screws. According to this configuration, it is possible to hide the cable draw-out cover holes 606 from the outside. Therefore, the appearance of the upper case can be enhanced and also the invasion of dust into the inside of the upper case can be prevented.

Figure 11A:
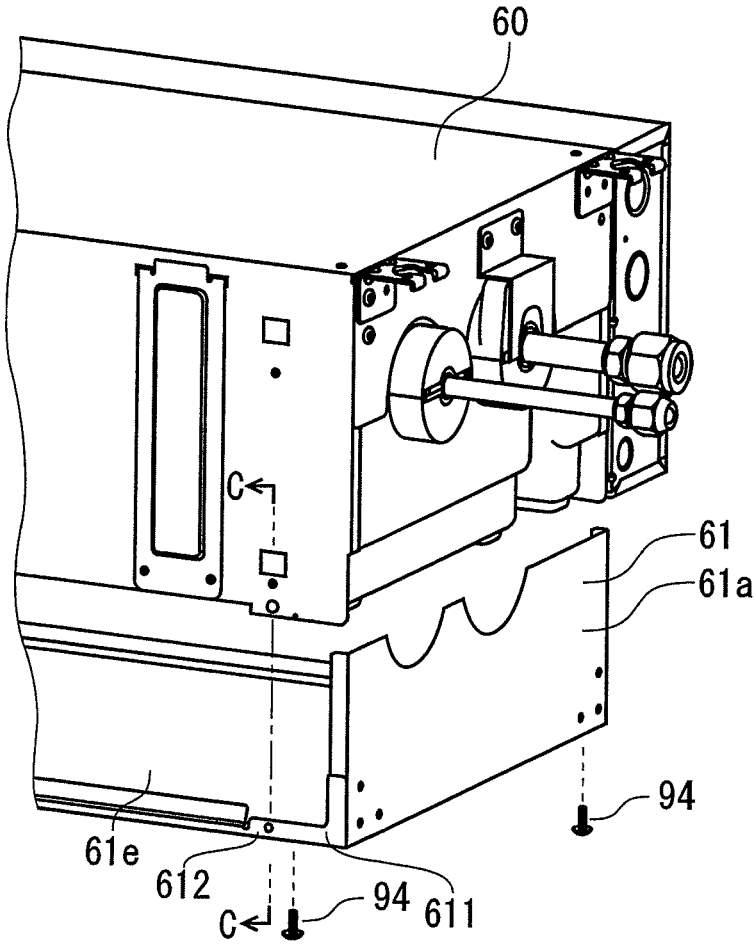
Figure 11A:
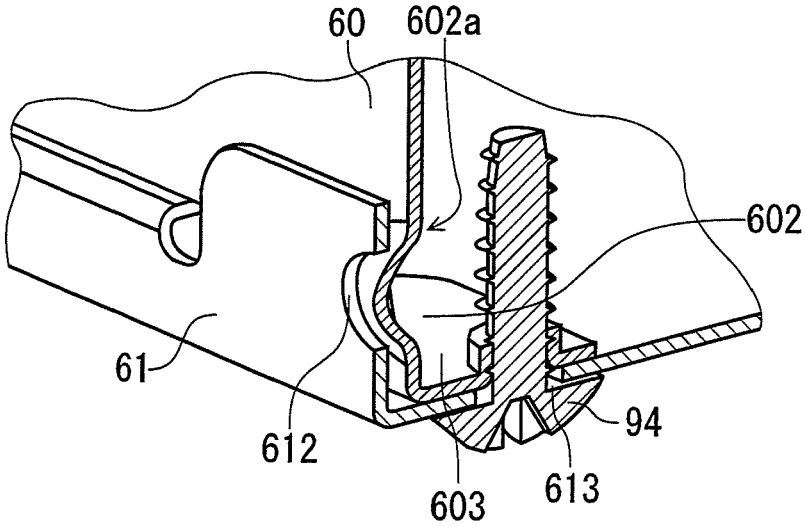
Figure 12A:
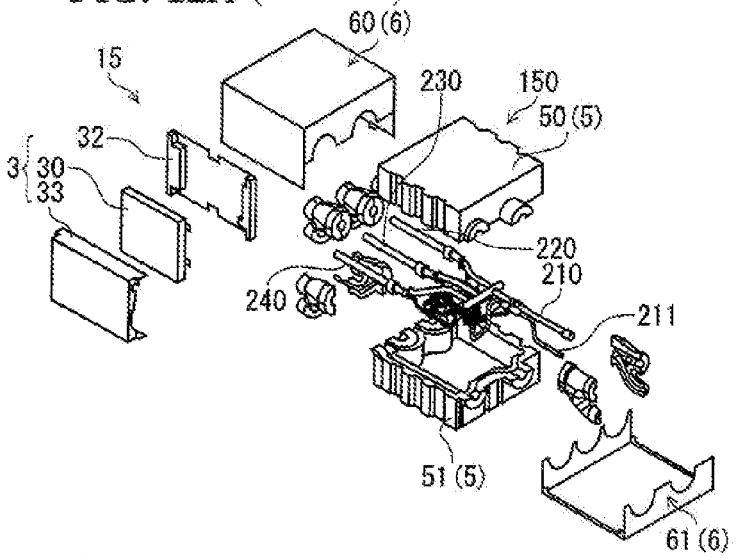
FIG. 12A (Prior Art)
FIGS. 12A and 12B are views showing a refrigerant distribution unit according to the related art.
Figure 12B:
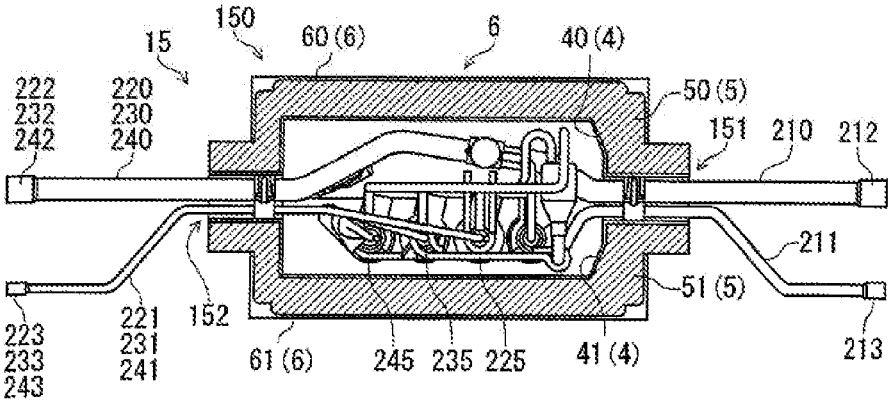
FIG. 12B (Prior Art)

Next, the lower case 61 is assembled to the upper case 60 in such a manner as shown in FIG. 11A. In this case, the dowel 602 provided on the upper case 60 is secured to a dowel hole 612 formed in the lower case 61, thereby fixing the lower case 61 provisionally. Next, the screws 94 are engaged with the screw mounting portion 603 of the bottom face 61*e* of the upper case 60 to thereby fix the upper case 60 and lower case 61 to each other.

When carrying out maintenance on the pipe unit 2, the screws 94 engaged with the screw mounting portion 603 are removed. In this case, even when the screws 94 are removed, the lower case 61 is fixed provisionally because of engagement of the dowel 602 into the dowel hole 612. Therefore, there is no fear that the lower case 61 can fall down unexpectedly.

Also, the base portion 602*a* of the dowel 602 provided on the upper case 60 has a round surface (a curved surface). When a portion of the round surface (curved surface) is contacted with the peripheral edge of the dowel hole 612, there can be formed a slight gap between such portions of the upper case 60 and lower case 61 as exist near to the dowel 602. Due to this configuration, when the dowel hole 612 is removed from the dowel 602 by an operator placing his or her fingers on the lower case 61, the dowel hole 612 can be removed smoothly and thus the lower case 61 can be removed easily.

As described above, the structure capable of provisionally fixing the lower case 61 to the upper case 60 in a removable manner is a structure which includes the dowel 602 provided on the upper case 60 and the dowel hole 612 formed in the lower case 61. That is, the present structure is characterized in that it is possible to fix the lower case 61 provisionally without using any new parts.

Here, the dowel 602 and dowel hole 612 are not limited to the above-mentioned structures. And, there may also be employed a structure in which the dowel hole 612 is formed in the upper case 60 and the dowel 602 is provided on the lower case 61.

As has been described heretofore, according to the exemplary embodiment, since the pipe unit 2 is fixed to the upper case 60 by the pipe hanging metal fittings 63, it is possible to provide a refrigerant branch unit for use in an air conditioner, in which, when carrying out maintenance on the branch portion 25, electronic expansion valve 225, 235, 245 and the like which constitute the pipe unit 2, by removing the lower case 61, lower insulator case 51 and lower seal case 41 with the main body 150 remaining mounted, the above-mentioned parts of the pipe unit 2 can be maintained without taking the main body 150 to pieces.

While the present inventive concept has been shown and described with reference to certain exemplary embodiments thereof, it will be understood by those skilled in the art that various changes in form and details may be made therein without departing from the spirit and scope of the invention as defined by the appended claims.

What is claimed is:

1. A refrigerant distribution unit for an air conditioner, comprising:

a pipe unit for distributing a refrigerant from a refrigerant pipe provided on an outdoor unit to a plurality of branch refrigerant pipes respectively provided on a plurality of indoor units; and a main body including:

an upper seal case and a lower seal case which include a storing portion configured to store the pipe unit, first edge portions formed in a periphery of the upper seal case and second edge portions formed in a periphery of the lower seal case, and engage the second edge portions with the first edge portions for sealing an inside of the first and second seal cases to store the pipe unit;

an upper insulator case and a lower insulator case for covering the upper seal case and the lower seal case respectively; and an upper case and a lower case respectively constituting a contour of the refrigerant distribution unit, wherein the upper seal case includes a pipe mounting portion in which a contact face with the pipe unit extends from the first edge portions, wherein the pipe unit is pushed and fixed to the pipe mounting portion by using a pipe holder and a pipe hanging bracket, wherein the upper insulator case includes an extending portion which extends along the contact face of the pipe mounting portion, wherein the pipe hanging bracket is provided so as to cover the extending portion of the upper insulator case, wherein an upper portion of the pipe hanging bracket is in direct contact with the upper case and directly clamped to the upper case by using a first screw, and a lower portion of the pipe hanging bracket extends from both sides of the pipe unit to under a bottom face of the pipe holder and fixed to the bottom face of the pipe holder by using a second screw which extends into the upper insulator case, wherein the lower portion of the pipe hanging bracket extends between the extending portion of the upper insulator case and the lower insulator case.

2. The refrigerant distribution unit according to claim 1, wherein the pipe hanging bracket is provided in at least a position of the outdoor unit side and at least a position of the indoor unit side, and wherein the pipe hanging bracket and the pipe holder are fastened to the pipe mounting portion.

* * * * *